US011388930B2

(12) United States Patent
Reevell

(10) Patent No.: US 11,388,930 B2
(45) Date of Patent: Jul. 19, 2022

(54) AEROSOL-GENERATING ARTICLE HAVING ROD WITH MULTIPLE LONGITUDINAL ELONGATE ELEMENTS OF NON-TOBACCO MATERIAL

(71) Applicant: Philip Morris Products S.A., Neuchatel (CH)

(72) Inventor: Tony Reevell, London (GB)

(73) Assignee: Philip Morris Products S.A., Neuchatel (CH)

( * ) Notice: Subject to any disclaimer, the term of this patent is extended or adjusted under 35 U.S.C. 154(b) by 58 days.

(21) Appl. No.: 16/636,552

(22) PCT Filed: Aug. 8, 2018

(86) PCT No.: PCT/EP2018/071488
§ 371 (c)(1),
(2) Date: Feb. 4, 2020

(87) PCT Pub. No.: WO2019/030276
PCT Pub. Date: Feb. 14, 2019

(65) Prior Publication Data

US 2020/0253274 A1 Aug. 13, 2020

(30) Foreign Application Priority Data

Aug. 9, 2017 (EP) ..... 17185602

(51) Int. Cl.
*A24F 13/00* (2006.01)
*A24F 40/40* (2020.01)
(Continued)

(52) U.S. Cl.
CPC ..... *A24F 40/40* (2020.01); *A24C 5/01* (2020.01); *A24D 1/20* (2020.01); *A24F 40/20* (2020.01)

(58) Field of Classification Search
CPC ..... A24F 47/00
(Continued)

(56) References Cited

U.S. PATENT DOCUMENTS 4,889,143 A 12/1989 Pryor et al.
4,889,144 A 12/1989 Tateno et al.
(Continued)

FOREIGN PATENT DOCUMENTS

EP 0 822 670 B1 11/2005
EP 2 760 303 B1 5/2015
(Continued)

OTHER PUBLICATIONS

International Search Report and Written Opinion dated Oct. 29, 2018 in PCT/EP2018/071488 filed Aug. 8, 2018.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating article for producing an inhalable aerosol upon heating is provided, the article including a rod of an aerosol-generating substrate, the rod including from about 20 strands to about 200 strands of non-tobacco material including and configured to release at least one aerosol former, each strand of the strands having an equivalent diameter of at least about 0.1 mm, the strands being assembled such that the strands extend in a longitudinal direction of the rod; and a wrapper circumscribing the strands.

11 Claims, 2 Drawing Sheets

(51) Int. Cl.
*A24C 5/01* (2020.01)
*A24D 1/20* (2020.01)
*A24F 40/20* (2020.01)

(58) Field of Classification Search
USPC ..... 131/328–329
See application file for complete search history.

(56) References Cited

U.S. PATENT DOCUMENTS

| | | | | |
|---|---|---|---|---|
| 2007/0023056 | A1 | 2/2007 | Cantrell et al. | |
| 2008/0241255 | A1* | 10/2008 | Rose | A61P 11/06 424/489 |
| 2012/0006343 | A1 | 1/2012 | Renaud et al. | |
| 2016/0250201 | A1 | 9/2016 | Rose et al. | |

FOREIGN PATENT DOCUMENTS

| | | | |
|---|---|---|---|
| EP | 2 814 342 | B1 | 3/2016 |
| EP | 2 713 778 | B1 | 4/2016 |
| RU | 2 602 969 | C2 | 11/2016 |
| WO | WO 2008/121610 | A1 | 10/2008 |
| WO | WO 2009/022232 | A2 | 2/2009 |
| WO | WO 2011/101164 | A1 | 8/2011 |
| WO | WO 2012/164009 | A3 | 12/2012 |
| WO | WO 2013/190036 | A1 | 12/2013 |
| WO | WO 2015/082652 | A1 | 6/2015 |
| WO | WO 2016/023965 | A1 | 2/2016 |
| WO | WO 2018/122097 | A1 | 7/2018 |

OTHER PUBLICATIONS

Russian Office Action and Search Report dated Nov. 26, 2021 in Russian Patent Application No. 2020104043/03(006227) (with English language translation), 11 pages.

* cited by examiner

AEROSOL-GENERATING ARTICLE HAVING ROD WITH MULTIPLE LONGITUDINAL ELONGATE ELEMENTS OF NON-TOBACCO MATERIAL

CROSS-REFERENCE TO RELATED APPLICATIONS

This application is a U.S. national stage application of PCT/EP2018/071488, filed on Aug. 8, 2018, which is based upon and claims the benefit of priority from European patent application no. 17185602.4, filed Aug. 9, 2017, the entire contents of each of which are incorporated herein by reference.

TECHNICAL FIELD

The present invention relates to an aerosol generating article comprising an aerosol-generating substrate, and to a method for the production of such an aerosol generating article.

DESCRIPTION OF THE RELATED ART

Aerosol-generating articles in which an aerosol-generating substrate, such as a tobacco-containing substrate, is heated rather than combusted, are known in the art. Typically in such heated smoking articles, an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article.

Substrates for heated aerosol-generating articles have, in the past, typically been produced using randomly oriented shreds, strands, or strips of tobacco material. The formation of rods for heated smoking or aerosol-generating articles from shreds of tobacco material suffers from a number of disadvantages. For example, the process of shredding tobacco material undesirably generates tobacco fines and other waste. Rods comprising shreds of tobacco material may exhibit "loose ends", that is, a loss of shreds of tobacco material from the ends of the rods. Rods comprising shreds of tobacco material may exhibit high standard deviations in weight, partially due to the tendency of rods to exhibit loose ends. Also, rods comprising shreds of tobacco material tend to exhibit non-uniform densities, that is, the density along the length of the rod tends to be inconsistent due to variations in the quantity of tobacco material at different locations along the rod. Furthermore, loose ends may disadvantageously lead to the need for more frequent cleaning of an aerosol-generating device for use with the aerosol-generating article and of manufacturing equipment.

By way of example, international patent application WO-A-2012/164009 discloses rods for heated aerosol-generating articles formed from gathered sheets of tobacco material. The rods disclosed in WO-A-2012/164009 have a longitudinal porosity that allows air to be drawn through the rods. Effectively, folds in the gathered sheets of tobacco material define longitudinal channels through the rod. The use of rods formed from gathered sheets of homogenised tobacco material addresses some of the problems associated with forming an aerosol-generating substrate from shredded tobacco. However, such sheets typically have a relatively low tensile strength and so the gathering of the sheets to form the rods can have drawbacks. International patent application WO-A-2011/101164 discloses alternative rods for heated aerosol-generating articles formed from strands of homogenised tobacco material, which may be formed by casting, rolling, calendering or extruding a mixture comprising particulate tobacco and at least one aerosol former to form a sheet of homogenised tobacco material. In an alternative embodiments, the rods of WO-A-2011/101164 may be formed from strands of homogenised tobacco material obtained by extruding a mixture comprising particulate tobacco and at least one aerosol former to form continuous lengths of homogenised tobacco material.

However, achieving consistent and accurate control of the amount of tobacco substrate in rods of the type described above can be difficult, particularly when operating at high speed. Further, depending on the shape and arrangement of sheets or strands of homogenised tobacco, it may be difficult to control the porosity and resistance to draw (RTD) of the aerosol generating article. Further, while they address some of the issues associated with forming an aerosol-generating substrate from shredded tobacco, rods formed from gathered sheets of homogenised tobacco material can have drawbacks during handling and manufacture because such sheets typically have a relatively low tensile strength.

Thus, it would be desirable to provide an aerosol generating article that does not use a tobacco sheet material. At the same time, it would be desirable to provide a substrate for one such aerosol generating article that facilitates the insertion of the heater into the substrate during use. It would be equally desirable to provide one such substrate or rod that can be manufactured efficiently and at high speed, as well as to provide a method of manufacturing such a rod.

SUMMARY

According to an aspect of the present invention, there is provided a heated aerosol-generating article for producing an inhalable aerosol, the heated aerosol-generating article comprising a rod of aerosol-generating substrate, wherein the rod of aerosol-generating substrate comprises from about 20 to about 200 strands of non-tobacco material comprising and adapted to release at least one aerosol former, each strand having an equivalent diameter of at least about 0.1 millimetres; wherein the strands are assembled such that the strands extend in the longitudinal direction; and a wrapper circumscribing the strands.

According to a further aspect of the present invention, there is provided a method of making a rod for use as an aerosol-generating substrate in an aerosol-generating article, the method comprising the steps of: providing a plurality of strands of non-tobacco material adapted to hold and release an aerosol former, each strand having an equivalent diameter of at least about 0.1 millimetres; assembling from about 20 to about 200 strands such that the assembled strands extend in the longitudinal direction; circumscribing the assembled strands with a wrapper to form a continuous rod; and severing the continuous rod into a plurality of discrete rods.

According to another aspect of the present invention, there is provided a rod for use as an aerosol-generating substrate in an aerosol-generating article, the rod comprising from about 20 to about 200 strands of non-tobacco material comprising and adapted to release at least one aerosol former, each strand having an equivalent diameter of at least about 0.1 millimetres, wherein the strands are assembled such that the strands extend in the longitudinal direction; and a wrapper circumscribing the strands.

BRIEF DESCRIPTION OF THE DRAWINGS

The invention will now be further described with reference to the figures in which.

DETAILED DESCRIPTION

Figure 1:
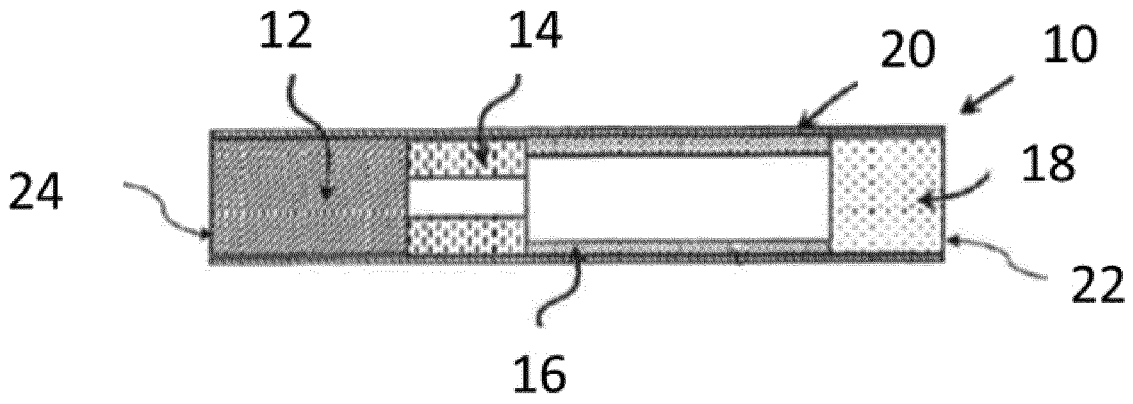
FIG. 1 shows a schematic longitudinal cross-sectional view of an aerosol-generating article for use with an aerosol-generating device comprising a heater element.

An equivalent diameter of 0.1 millimetres of the strands of non-tobacco material has the advantage over smaller strand diameters that the ratio between the collective volume of the strands present in the rod and the surface area of the strands present in the rod is increased.

The outer surface area of each strand increases linear with the increase in the diameter. On the other hand, the surface area of the cross-section and the volume of each individual strand substantially increase quadratic with the diameter of the individual strand. Without wishing to be bound by theory, it is understood that, as the diameter of each individual strand increases, the number of strands present in a rod of a given diameter decreases. Thus, an increase in the individual strand diameter increases is generally accompanied by a very small—or even negligible or null—variation in the collective volume of the strands contained in the rod, because the effect of the reduction in the number of strands in the rod is substantially countered by the increase in the individual strand cross-sectional surface area. By contrast, an increase in the individual strand diameter is generally associated with a reduction in the collective outer surface of the plurality of strands, since the linear growth of the surface area of each strand is not enough to compensate the effect of the reduction in the number of strands in the rod. The inventors have found that at equivalent diameters of 0.1 millimetres and above the amount of material (for example, the amount of aerosol former) that can be captured inside the strands, which is proportional to the collective volume of the strands, is significantly improved over the amount of material that can be captured in the gaps between the strands. Release of the material captured inside the strands can be controlled better than the release of the material captured on the outer surface of the strands. Therefore, larger equivalent diameters overall lead to an improved control of the release of the aerosol former in aerosol-generating articles in accordance with the present invention.

It will be appreciated that any features described with reference to one aspect of the present invention are equally applicable to any other aspect of the invention.

The term "aerosol generating article" is used herein to denote both articles wherein an aerosol generating substrate is heated and articles wherein an aerosol generating substrate is combusted, such as conventional cigarettes. As used herein, the term "aerosol generating substrate" denotes a substrate capable of releasing volatile compounds upon heating to generate an aerosol.

In heated aerosol generating articles, an aerosol is generated by heating a flavour generating substrate, such as tobacco, without combustion. Known heated aerosol generating articles include, for example, electrically heated aerosol generating articles and aerosol generating articles in which an aerosol is generated by the transfer of heat from a combustible fuel element or heat source to a physically separate aerosol forming material. For example, aerosol generating articles according to the invention find particular application in aerosol generating systems comprising an electrically heated aerosol generating device having an internal heater blade which is adapted to be inserted into the rod of aerosol generating substrate. Aerosol generating articles of this type are described in the prior art, for example, in European patent application EP 0822670. As used herein, the term "aerosol generating device" refers to a device comprising a heater element that interacts with the aerosol generating substrate of the aerosol generating article to generate an aerosol. Alternatively, aerosol generating article according to the invention may comprise a combustible carbon heat source for heating the aerosol generating substrate during use. Aerosol generating articles of this type are described in the prior art, for example, in international patent application WO 2009/022232. Also known are aerosol generating articles in which a nicotine-containing aerosol is generated from a tobacco material, tobacco extract, or other nicotine source, without combustion, and in some cases without heating, for example through a chemical reaction. During smoking, volatile compounds are released from the aerosol forming substrate by heat transfer from the fuel element and entrained in air drawn through the aerosol generating article. As the released compounds cool they condense to form an aerosol.

As used herein, the term "strand" denotes a strip, shred, filament, rod or other elongate element.

The term "length" denotes the dimension of a component of the aerosol-generating article in the longitudinal direction. For example, it may be used to denote the dimension of the rod or of the strands of non-tobacco material in the longitudinal direction.

As used herein, the term "longitudinal" refers to the direction corresponding to the main longitudinal axis of the aerosol-generating article, which extends between the upstream and downstream ends of the aerosol-generating article. During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "equivalent diameter of a strand" is used herein to denote the diameter of the circle which has the same surface area as the transverse cross-section of the strand. For a strand having a circular transverse cross-section, the equivalent diameter is the diameter of the cross-section of the strand.

As used herein, the terms "upstream" and "downstream" describe the relative positions of elements, or portions of elements, of the aerosol-generating article in relation to the direction in which the aerosol is transported through the aerosol-generating article during use.

As briefly described above, the aerosol generating article of the present invention incorporates a rod of aerosol-generating substrate. The rod of aerosol-generating substrate comprises from about 20 to about 200 strands of non-tobacco material comprising and adapted to release at least one aerosol former, each strand having an equivalent diameter of at least about 0.1 millimetres. The strands are assembled such that the strands extend in the longitudinal direction.

By adjusting the size and number of the strands of non-tobacco material in the rod, it is advantageously possible to adjust the density and porosity of the rod. In general, aerosol-generating substrates comprising a plurality of strands of non-tobacco material in accordance with the invention also advantageously exhibit more uniform densities than aerosol-generating substrates comprising shreds of tobacco material. Thus, the RTD and permeability to airflow of the rod can be finely tuned consistently.

Further, by varying the composition and internal porosity of the non-tobacco material from which the strands are formed, it is possible to vary the amount of aerosol former that can be loaded in the rod.

The weight of an aerosol-generating substrate comprising strands of non-tobacco material is determined by the number, size, density and spacing of the strands. The weight of aerosol-generating substrates comprising a plurality of strands of non-tobacco material can thus be regulated by controlling the density, dimensions, aerosol-former load of the strands and the arrangement of the strands within the rod. This reduces inconsistencies in weight between aerosol-generating substrates of the same dimensions compared to aerosol-generating substrate comprising shreds of tobacco material.

The regular arrangement of the strands in the rod optimizes heat transfer from the heater through the rod during use. At the same time, the size, geometry and arrangement of the strands in the rod can be readily adapted to facilitate the insertion of a heating element. By way of example, by arranging the strands substantially straight within the rod and extending longitudinally, insertion of a longitudinally extending heater element, such as a heater blade, is greatly facilitated.

Insertion of a heater element of an aerosol-generating device into an aerosol-generating substrate comprising shreds of tobacco material and withdrawal of a heater element of an aerosol-generating device into an aerosol-generating substrate comprising shreds of tobacco material may tend to dislodge shreds of tobacco material from the aerosol-generating substrate. This can disadvantageously result in the need for more frequent cleaning of the heater element and other parts of the aerosol-generating device in order to remove the dislodged shreds. In contrast, insertion and withdrawal of a heater element of an aerosol-generating device into an aerosol-generating substrate comprising a plurality of strands of non-tobacco material advantageously has a significantly reduced tendency to dislodge material.

Rods in accordance with the present invention can be made in a continuous process which can be efficiently carried out at high speed, and can be conveniently incorporated into existing production lines for the manufactured of heated aerosol generating articles.

The rod of aerosol generating substrate preferably has an external diameter that is approximately equal to the external diameter of the aerosol generating article.

Preferably, the rod of aerosol generating substrate has an external diameter of at least 5 millimetres. The rod of aerosol generating substrate may have an external diameter of between about 5 millimetres and about 12 millimetres, for example of between about 5 millimetres and about 10 millimetres or of between about 6 millimetres and about 8 millimetres. In a preferred embodiment, the rod of aerosol generating substrate has an external diameter of 7.2 millimetres, to within 10 percent.

The rod of aerosol generating substrate may have a length of between about 5 millimetres and about 100 mm. Preferably, the rod of aerosol generating substrate has a length of at least about 5 millimetres, more preferably at least about 7 millimetres. In addition, or as an alternative, the rod of aerosol generating substrate preferably has a length of less than about 25 millimetres, more preferably less than about 20 millimetres. In one embodiment, the rod of aerosol generating substrate may have a length of about 10 millimetres. In a preferred embodiment, the rod of aerosol generating substrate has a length of about 12 millimetres.

Preferably, the rod of aerosol generating substrate has a substantially uniform cross-section along the length of the rod. Particularly preferably, the rod of aerosol generating substrate has a substantially circular cross-section.

Aerosol generating articles in accordance with the present invention comprise an aerosol generating substrate, which may be provided as a rod comprising strands of non-tobacco material circumscribed by a wrapper. As used herein, the term 'rod' is used to denote a generally cylindrical element of substantially circular, oval or elliptical cross-section. In principle, also other and more complicated cross-sections for the strands are possible, like star shaped, X-shaped or Y-shaped. However, in the context of the present invention, those cross-sectional shapes that allow a reasonably tight packing of the strands, but at the same time have a favourable ratio between the surface area of a circle circumscribed to the cross-section of the strand and the effective surface area of the cross-section of the strand are preferred. This is because, in the context of the present invention, shapes that enable packing a greater collective strand volume in the rod are generally preferred over shapes corresponding to greater collective outer surface areas of the strands. In this respect, a circular shape, or quasi-circular shape (such as oval or elliptical) is ideal. Triangular and rectangular cross-sections are also possible. However, with triangular and rectangular cross-sections, the strands may become packed even too tight, such as to reduce the space available for airflow among the strands.

The strands may be formed from a heat-resistant material that is coated with or soaked in an aerosol-former. The term "heat-resistant material" is used herein to describe a material capable of withstanding and remaining substantially unaffected by heat when exposed at temperatures at least as high as the typical operating temperatures of a heated aerosol-generating article. By way of example, the strands may be formed by an extrusion process.

As used herein, the term "aerosol former" describes any suitable known compound or mixture of compounds that, in use, facilitates formation of an aerosol and that is substantially resistant to thermal degradation at the operating temperature of the aerosol-generating article. Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as propylene glycol, triethylene glycol, 1,3-butanediol and, most preferred, glycerine.

The aerosol former may be provided as a liquid or a gel. In some embodiments, the aerosol former may be provided in a composition further comprising nicotine or a flavourant or both.

By way of example, the heat-resistant material may be a ceramic material. The heat-resistant material may be glass, such as in the form of glass fibre.

In some embodiments, the non-tobacco material may comprise a flexible string-like material such as a flexible rod, that may be provided on a coil or roll. This may comprise glass fibre or be an extruded, flexible, non-tobacco carrier comprising a fibrous material.

The strands may be more or less flexible. The aerosol former may wick between strands or may be substantially viscous so as not to wick between strands.

Preferably, the non-tobacco material of the strands is adapted to adsorb the aerosol former on its surface or to absorb the aerosol former within its structure. In other words, the non-tobacco material of the strands is such that the aerosol former can become attached to the strands by sorption and released by desorption. In some embodiments, the strands may be formed from a non-tobacco material such that the aerosol former (the adsorbate) can reversibly adhere to the surface of the strands (the adsorbent) to form a superficial film thereon. This is based on the formation of bonds between the aerosol former molecules and the surface of the strands, such as weak van der Waals forces (physisorption) or covalent bonds (chemisorption) or electrostatic attraction. In other embodiments, the strands may be formed from a non-tobacco material such that the aerosol former (the absorbate) reversibly permeates into the volume of the strands. This process may be chemical—that is, it may involve a reaction between the aerosol former and the non-tobacco material of the strands—or the process may be purely physical (non-reactive), or the process may be a combination of a chemical and physical process.

This advantageously enables improved control of the aerosol former load, that is, of the amount of aerosol former provided in the rod of aerosol generating articles in accordance with the invention. Without wishing to be bound by theory, it is understood that this may also advantageously facilitate control of the release profile. By way of example, it may be easier to control under which conditions (for example, in terms of temperature) or at what stage during use the release of aerosol from the strands is favoured or maximised.

This is an improvement over other non-tobacco materials commonly used in aerosol generating articles, such as cellulose acetate tow. An aerosol former does not become attached to cellulose acetate fibres by sorption, but merely occupies the voids and gaps between adjacent fibres.

In some embodiments, compression or squeezing of the strands of non-tobacco material loaded with the aerosol former may be required to release the aerosol former from the strands, or for an enhanced, repeated or prolonged release of aerosol former from the strands.

In some embodiments, all the strands of non-tobacco material are equally loaded with aerosol former. This results in a substantially homogenous distribution of aerosol former across the cross-section of the rod of aerosol generating substrate. It will be appreciated that, because there may generally be gaps and voids between adjacent strands, the term "homogeneous distribution" is used herein to describe an aerosol former concentration profile that is not exactly constant across the cross-section of the rod of aerosol generating substrate In other embodiments, the plurality of strands comprises a first group of strands having a first aerosol former load and a second group of strands having a second aerosol former load, the second aerosol former load being greater than the first aerosol former load. This advantageously enables the achievement of a non-homogeneous aerosol former distribution across a cross-section of the rod of aerosol generating substrate. In other words, an aerosol former concentration profile over the cross-section of the rod of aerosol generating substrate may be tuned in a predetermined fashion. By way of example, strands arranged at the core of the rod may have a greater aerosol former load than strands arranged at the periphery of the rod.

The strands of non-tobacco material may be adapted to allow a flow of air in a longitudinal direction through the rod during use. The number, size and mutual arrangements of the strands may be adjusted to ensure that the rod has the required porosity and that the RTD of the aerosol-generating article falls within a range of values acceptable for the consumer.

Preferably, each strand of non-tobacco material has an equivalent diameter of less than about 1 millimetres. Even more preferably, each strand of non-tobacco material has an equivalent diameter of less than about 0.5 millimetres.

In some embodiments, the plurality of strands comprises a first group of strands having a first equivalent diameter and a second group of strands having a second equivalent diameter, the second equivalent diameter being smaller than the first equivalent diameter. This may advantageously enable a finer control of the porosity of the rod, wherein different portions of the rod of aerosol generating substrate have different values of porosity.

By way of example, the first group of strands may be arranged at a central location in the rod, the second group of strands being arranged at the periphery of the rod. Preferably, the first group of strands may be substantially surrounded by the strands of the second group of strands. Thus, greater voids are provided at a substantially axial location in the rod, whereas smaller gaps between adjacent strands are provided at the periphery of the rod.

Preferably, each strand has a length substantially equal to the length of the rod of aerosol generating substrate. In one embodiment, each strand has a length of between about 5 millimetres and about 80 millimetres. In a preferred embodiment, each tubular element has a length of between about 7 millimetres and about 40 and most preferably, each tubular element has a length of between about 8 millimetres and about 28 millimetres.

The rod of aerosol generating substrate comprises less than about 200 strands of non-tobacco material. Preferably, the rod of aerosol generating substrate comprises less than about 150 strands of non-tobacco material. More preferably, the rod of aerosol generating substrate comprises less than about 100 strands of non-tobacco material.

The rod of aerosol generating substrate comprises at least about 20 strands of non-tobacco material. Preferably, the rod of aerosol generating substrate comprises at least about 30 strands of non-tobacco material. More preferably, the rod of aerosol generating substrate comprises at least about 40 strands of non-tobacco material. In particularly preferred embodiments, the rod of aerosol generating substrate comprises from about 20 to about 100 strands of non-tobacco material.

In some embodiments, the plurality of strands of non-tobacco material are aligned substantially parallel to one another within the aerosol-generating substrate. Preferably, the strands of non-tobacco material extend substantially in the longitudinal direction of the rod of aerosol-generating substrate. This is advantageous in that it enables a precise determination and control of the void fraction of the rod, that is, of the overall volume of voids among the strands. This may impact the total amount of aerosol former that may be held within the rod of aerosol-generating substrate.

Further, a part of the overall volume of voids will generally be obstructed by the aerosol former, and this may therefore impact the RTD of the aerosol generating article. In those embodiments where the non-tobacco material of the strands is adapted to adsorb the aerosol former on its surface or to absorb the aerosol former within its structure, this is advantageously countered because the aerosol is also, or substantially entirely, attached to the material of the strands.

In preferred embodiments, the strands are of substantially square transverse cross-section, substantially rectangular transverse cross-section or substantially oval transverse cross-section. Strands of substantially oval transverse cross-section may be of substantially elliptical or circular cross-section.

In some embodiments, the strands of non-tobacco material in the rod are preferably arranged with a predetermined spacing between adjacent strands. By way of example, this may be achieved by providing particulate matter, such as carbon, arranged on the outer surface of the strands, such that adjacent strands are at a distance from one another, the distance being substantially a function of an average size (for example, an average equivalent diameter) of the particles.

As described above, the plurality of strands of non-tobacco material forming the rod of aerosol-generating substrate are circumscribed by a wrapper. The wrapper may be formed of a porous or non-porous sheet material. The wrapper may be formed of any suitable material or combination of materials. Preferably, the wrapper is a paper wrapper. The wrapper may optionally be adhered to the outer edges of the plurality of strands. For example, at least one of the inner surface of the wrapper and the outer edges of the plurality of strands may be wetted during the production process such that the inner wrapper adheres to the edges of the strands during the wrapping process. Alternatively, an adhesive may be applied to at least one of the inner surface of the wrapper and the outer edges of the plurality of strands upstream of the wrapping step. The adhesion of the plurality of strands and the wrapper may advantageously help to retain the position and spacing of the plurality of strands within the rod.

The wrapper may optionally be at least partially folded over the strands at the upstream and downstream ends of the rod to retain the plurality of strands within the rod. Preferably, the wrapper overlies the periphery of the plurality of strands at the upstream and downstream ends of the rod so that the remainder of the strands is exposed. However, in some embodiments the wrapper may overlie the entire upstream and downstream ends of the rod. In such embodiments, air flow may advantageously be made possible by providing a wrapper having a sufficient porosity to enable air flow through the ends of the rod.

As an alternative to folding the ends of the wrapper over the upstream and downstream strands of non-tobacco material, a separate rim section of paper or other material may be attached to the wrapper to overlie at least the periphery of the upstream and downstream ends of the strands, as described above. In such embodiments where the wrapper is folded over the ends of the rod, or where a separate rim section is provided, an additional outer wrapper may be provided overlying the wrapper that circumscribes the plurality of strands.

The aerosol-generating articles according to the invention preferably comprise one or more elements in addition to the rod of aerosol-generating substrate, wherein the rod and the one or more elements are assembled within a substrate wrapper. For example, aerosol-generating articles according to the invention may further comprise at least one of: a mouthpiece, an aerosol-cooling element and a support element such as a hollow acetate tube. For example, in one preferred embodiment, an aerosol-generating article comprises, in linear sequential arrangement, a rod of aerosol-generating substrate as described above, a support element located immediately downstream of the aerosol-generating substrate, an aerosol-cooling element located downstream of the support element, and an outer wrapper circumscribing the rod, the support element and the aerosol-cooling element.

In an embodiment of the present invention, a rod for use as an aerosol-generating substrate in an aerosol-generating article comprises from about 20 to about 200 strands of non-tobacco material comprising and adapted to release at least one aerosol former, each strand having an equivalent diameter of at least about 0.1 millimetres, wherein the strands are assembled such that the strands extend in the longitudinal direction; and a wrapper circumscribing the strands.

One such rod may be manufactured by a method according to another aspect of the invention, as defined above. In a first step of the method according to the invention, there is provided a plurality of strands of non-tobacco material adapted to hold and release an aerosol former, each strand having an equivalent diameter of at least about 0.1 millimetres. In a second step, from about 20 to about 200 strands of the plurality of strands are assembled together such that the assembled strands extend in the longitudinal direction. By way of example, this may be achieved by feeding the plurality of strands through a funnel element such that they are grouped in a substantially cylindrical cluster. Multiple strands may be fed from different reels.

In a third step, the assembled strands are circumscribed with a wrapper to form a continuous rod. In a fourth step, the continuous rod is severed into a plurality of discrete rods.

Preferably, the method comprises a further step of applying at least one aerosol former to the strands prior to the step of assembling the plurality of strands. More preferably, the method further comprises a step of drying the plurality of strands after the step of applying the at least one aerosol former to the strands and prior to the step of assembling the plurality of strands.

As an alternative, the method may comprise a further step of applying at least one aerosol former to the plurality of strands after they have been assembled. In a preferred embodiment, one such method may further comprise a step of drying the plurality of strands after the step of applying the at least one aerosol former to the assembled strands.

As a further alternative, the method may comprise a step of applying at least one aerosol former to the plurality of strands following the step of severing the continuous rod into discrete rods. Severing means are provided at a cutting station to which the continuous rod is fed.

The steps of circumscribing the plurality of strands with the wrapper to form a continuous rod and severing the continuous rod to form discrete rods may be carried out using existing apparatus and techniques, which would be known to the skilled person.

The aerosol-generating article 10 shown in FIG. 1 comprises a rod of aerosol-generating substrate 12, a hollow cellulose acetate tube 14, a spacer element 16 and a mouthpiece filter 18. These four elements are arranged sequentially and in coaxial alignment and are circumscribed by a substrate wrapper 20 to form the aerosol-generating article 10. The aerosol-generating article 10 has a mouth end 22 and a distal end 24 located at the opposite end of the article to the mouth end 22. The aerosol-generating article 10 shown in FIG. 1 is particularly suitable for use with an electrically operated aerosol-generating device comprising a heater for heating the rod of aerosol-generating substrate.

The rod of aerosol-generating substrate 12 has a length of approximately 12 millimetres and a diameter of approximately 7 millimetres. The rod 12 is cylindrical in shape and has a substantially circular cross-section.

Figure 2:
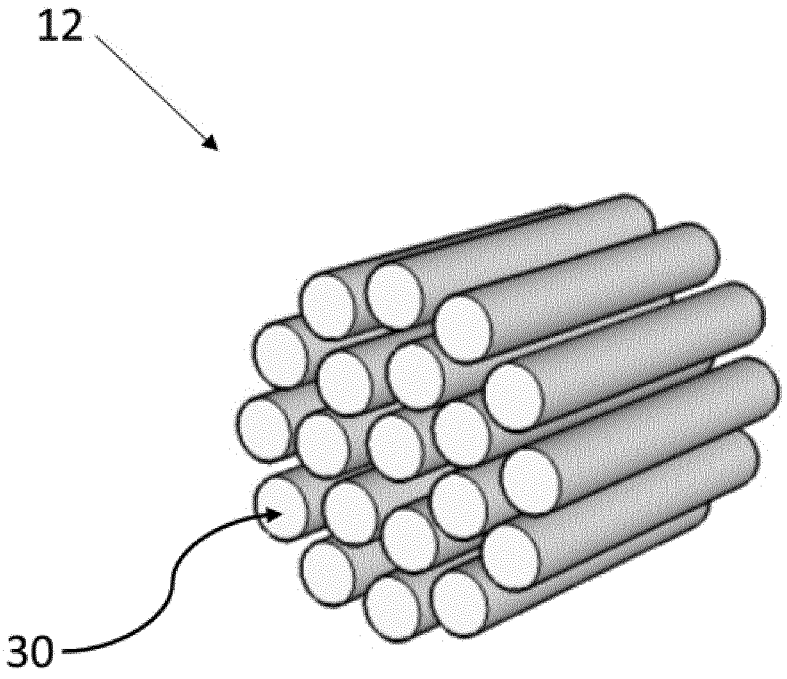
FIG. 2 shows a schematic perspective view of an aerosol-generating substrate according to a first embodiment of the invention, with the wrapper removed.
Figure 3:
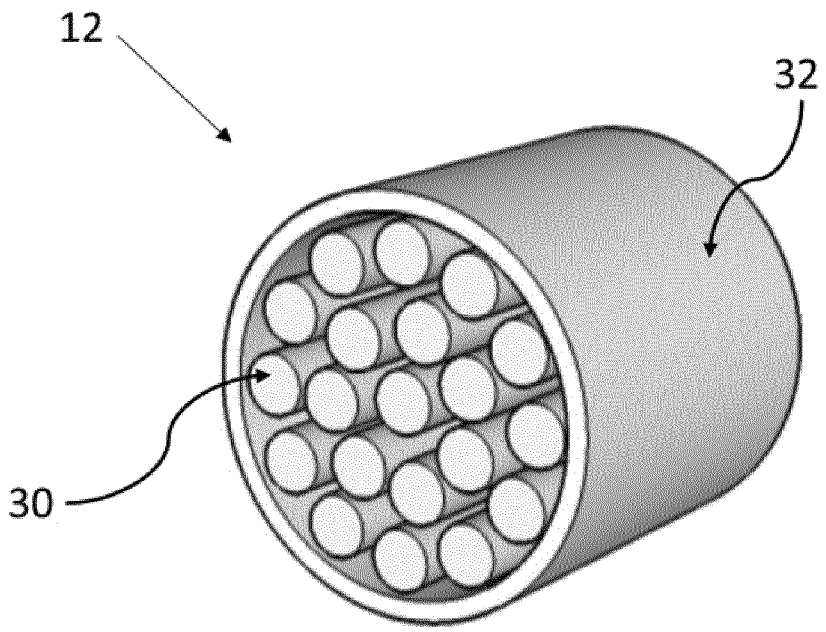
FIG. 3 shows a schematic perspective view of the aerosol-generating substrate of FIG. 2, with the wrapper in place.

An embodiment of a rod of aerosol-generating substrate 12 for use in the aerosol-generating article 10 of FIG. 1 is shown in FIGS. 2 and 3. The rod 12 comprises a plurality of strands 30 of non-tobacco material circumscribed by a paper wrapper 32. In FIG. 2, the plurality of strands 30 of non-tobacco material are shown with the wrapper 32 removed.

As can be seen in FIG. 2, each of the strand extends in the longitudinal direction and has a length substantially corresponding to the length of the rod 12. The strands 30 are parallel to each other and stacked such that adjacent strands are loosely in contact with one another. The strands 30 have substantially circular cross-section and an equivalent diameter of about 1 millimetre. Longitudinal channels extending through the rod 12 are defined among the strands. Thus, the rod 12 is adapted to receive a heater blade of an aerosol-generating device, as described below, and to provide an air flow pathway through which air can be drawn through the rod 12 during use.

Figure 4:
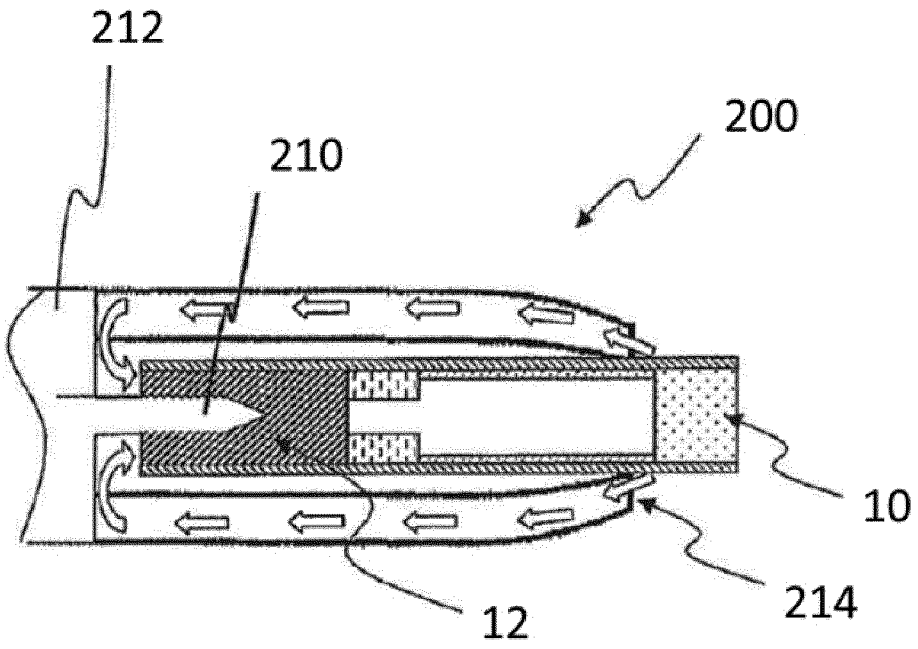
FIG. 4 shows a schematic longitudinal cross-sectional view of an aerosol-generating system comprising an electrically operated aerosol-generating device and the aerosol-generating article shown in FIG. 1.

FIG. 4 shows a portion of an electrically operated aerosol-generating system 200 that utilises a heater blade 210 to heat the rod of aerosol-generating substrate 12 of the aerosol-generating article 10 shown in FIG. 1. The heater blade 210 is mounted within an aerosol-generating article chamber within a housing of an electrically operated aerosol-generating device 212. The aerosol-generating device 212 defines a plurality of air holes 214 for allowing air to flow to the aerosol-generating article 10, as illustrated by the arrows in FIG. 4. The aerosol-generating device 212 comprises a power supply and electronics, which are not shown in FIG. 4.

The aerosol-generating article 10 shown in FIG. 1 is designed to engage with the aerosol-generating device 212 shown in FIG. 4 in order to be consumed. The user inserts the aerosol-generating article 10 into the aerosol-generating device 212 so that the heater blade 210 is inserted into the rod of aerosol-generating substrate 12, through the strands of non-tobacco material 30. The mouthpiece filter 18 projects outwards from the mouth end of the device 212. Once the aerosol-generating article 10 is engaged with the aerosol-generating device 212, the user draws on the mouth end 22 of the aerosol-generating article 10 and the rod of aerosol-generating substrate 12 is heated by the heater blade 210 to a temperature sufficient to generate an aerosol from the rod of aerosol-generating substrate 12. The aerosol is drawn through the mouth end filter 18 and into the user's mouth.

It will be appreciated that the aerosol-generating article 10 shown in FIG. 1 may also be suitable for use with other types of aerosol-generating devices.

The invention claimed is:

1. A heatable aerosol-generating article for producing an inhalable aerosol, the heatable aerosol-generating article comprising:

a rod of an aerosol-generating substrate, the rod of the aerosol-generating substrate comprising:

from about 20 strands to about 200 strands of non-tobacco material comprising and configured to release at least one aerosol former, each strand of the strands having an equivalent diameter of at least about 0.1 mm and less than about 0.5 mm, the strands being assembled such that the strands extend in a longitudinal direction of the rod; and a paper wrapper circumscribing the strands.

2. The heatable aerosol-generating article according to claim 1, wherein the non-tobacco material is configured to adsorb the aerosol former on a surface thereof or to absorb the at least one aerosol former within a structure thereof.

3. The heatable aerosol-generating article according to claim 1, wherein each strand of the strands of non-tobacco material has a length substantially equal to a length of the rod.

4. The heatable aerosol-generating article according to claim 1, wherein the strands of non-tobacco material are aligned substantially parallel to one another within the aerosol-generating substrate.

5. The heatable aerosol-generating article according to claim 1, wherein the strands are of substantially square transverse cross-section, substantially rectangular transverse cross-section, or substantially oval transverse cross-section.

6. The heatable aerosol-generating article according to claim 1, wherein the strands comprise a heat resistant material coated with or soaked in the at least one aerosol former.

7. A method of making a rod for an aerosol-generating substrate in an aerosol-generating article, the method comprising:

providing a plurality of strands of non-tobacco material configured to hold and to release an aerosol former, each strand of the plurality of strands having an equivalent diameter of at least about 0.1 mm and less than about 0.5 mm;

assembling from about 20 strands to about 200 strands such that the assembled strands extend in a longitudinal direction of the rod;

circumscribing the assembled strands with a paper wrapper to form a continuous rod; and severing the continuous rod into a plurality of discrete rods.

8. The method according to claim 7, further comprising applying at least one aerosol former to the plurality of strands prior to the assembling.

9. The method according to claim 8, further comprising a step of drying the plurality of strands after a step of applying at least one aerosol former to the plurality of strands and prior to the step of assembling.

10. The method according to claim 7, further comprising a step of applying at least one aerosol former to the plurality of strands following the step of severing the continuous rod.

11. A rod for an aerosol-generating substrate in an aerosol-generating article, the rod comprising:

from about 20 strands to about 200 strands of non-tobacco material comprising and configured to release at least one aerosol former, each strand of the strands having an equivalent diameter of at least about 0.1 mm and less than about 0.5 mm, the strands being assembled such that the strands extend in a longitudinal direction of the rod; and a paper wrapper circumscribing the strands.

* * * * *